US006893234B2

(12) United States Patent
Sun et al.

(10) Patent No.: US 6,893,234 B2
(45) Date of Patent: May 17, 2005

(54) NON-CIRCULAR CENTERED SEAL FOR BACK PRESSURE CHAMBER

(75) Inventors: Zili Sun, Arkadelphia, AR (US); Carlos Zamudio, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/345,643

(22) Filed: Jan. 16, 2003

(65) Prior Publication Data

US 2004/0141864 A1 Jul. 22, 2004

(51) Int. Cl.[7] ..... F04C 18/00
(52) U.S. Cl. ..... 418/55.5; 418/57; 418/55.4
(58) Field of Search ..... 418/55.5, 57, 55.4

(56) References Cited

U.S. PATENT DOCUMENTS 5,833,443 A * 11/1998 Lifson ..... 418/55.5
6,077,057 A * 6/2000 Hugenroth et al. ..... 418/55.5
6,290,478 B1 9/2001 Lifson

FOREIGN PATENT DOCUMENTS

JP 07035062 A * 2/1995 ..... F04C/18/02
WO WO 9911936 A1 * 3/1999 ..... F04C/18/04

* cited by examiner

*Primary Examiner*—Theresa Trieu
(74) *Attorney, Agent, or Firm*—Carlson, Gaskey & Olds

(57) ABSTRACT

A scroll compressor is provided with a non-circular back pressure chamber which is still concentric about a center axis of the compressor, such as the center axis of the drive shaft. Stated another way, an inner seal and an outer seal define a back pressure chamber. The two seals are concentric, but at least one of the seals is non-circular. In this way, reduced a back pressure chamber can be provided while still allowing the amount of orbital movement necessary for the tap for communicating a compressed refrigerant to the back pressure chamber.

12 Claims, 2 Drawing Sheets

NON-CIRCULAR CENTERED SEAL FOR BACK PRESSURE CHAMBER

BACKGROUND OF THE INVENTION

This application relates to a seal for defining a back pressure chamber in a scroll compressor, wherein the seal is non-circular, but still centered on a center axis.

Scroll compressors are becoming widely utilized in refrigerant compression applications. In a scroll compressor, a first scroll member has a base with a generally spiral wrap extending from the base. A second scroll member has its own base and spiral wrap. The two wraps interfit to define compression chambers. One of the two scroll members is caused to orbit relative to the other. As relative orbital movement occurs between the wraps, the size of the compression chambers is reduced, thus compressing an entrapped refrigerant.

While scroll compressors are becoming very successful, they do raise certain design challenges. One challenge is that the compressed refrigerant tends to force the two scroll members away from each other. This so-called "separating force" would cause the wraps to move out of contact with the base of the opposed scroll member, and reduce the efficiency of compression. Hence, a back pressure chamber has been created in known scroll compressors.

The back pressure chamber taps a small amount of compressed refrigerant to an area which resists movement of one of the two scroll members away from each other. Thus, the back pressure chamber receives the compressed refrigerant and the force from this compressed refrigerant forces the one scroll member toward the other, resisting the separating force.

In certain scroll compressors, it would be desirable to compress only a small volume of refrigerant. Thus, the separating force will be less than it would be in higher volume compression applications. Since the separating force is lower, it would be desirable to also have a lower back pressure force.

Typically, two seals define the back pressure chambers and have been concentric and circular. This raises a limitation on how small the back pressure chamber can be, and thus raises difficulties for designing back pressure chambers in smaller volume compressors. In particular, a minimum "orbit radius" is still required for the scroll compressor, even when the volumes are small. As the orbiting scroll orbits, the tap which taps refrigerant into the back pressure chamber, also orbits. Since there is a minimum amount of movement during this orbiting movement, the outer diameter of the seal which defines the back pressure chamber, must still be beyond the entirety of this orbit radius. Stated another way, the tap must be between the seals throughout the entire orbiting cycle.

One proposed scroll compressor has had its back pressure chamber offset relative to a center axis. The reason for this offset is to resist particular forces. In U.S. Pat. No 6,290,478, protecting this invention, a statement was made that the seal could be oval, oblong, or other non-circular shapes. The resultant back pressure chamber is offset relative to the center axis. This arrangement would not address the problem mentioned above, wherein it would still be desirable to have the back pressure chamber centered on a center axis, but simply have the back pressure chamber be smaller.

SUMMARY OF THE INVENTION

In the disclosed embodiment of this invention, the back pressure chamber is non-circular, but centered on a center axis of a shaft for driving the scroll member. In one preferred embodiment, the back pressure chamber is defined by an inner circular seal and an outer oblong seal. The oblong seal is still centered on the center axis for the inner seal. Thus, the back pressure chamber is concentric. In other embodiments, both seals could be oblong, which would allow greater control over the final size of the back pressure chamber.

These and other features of the present invention may be best understood from the following specification and drawings, the following of which is a brief description.

DETAILED DESCRIPTION OF A PREFERRED EMBODIMENT

Figure 1:
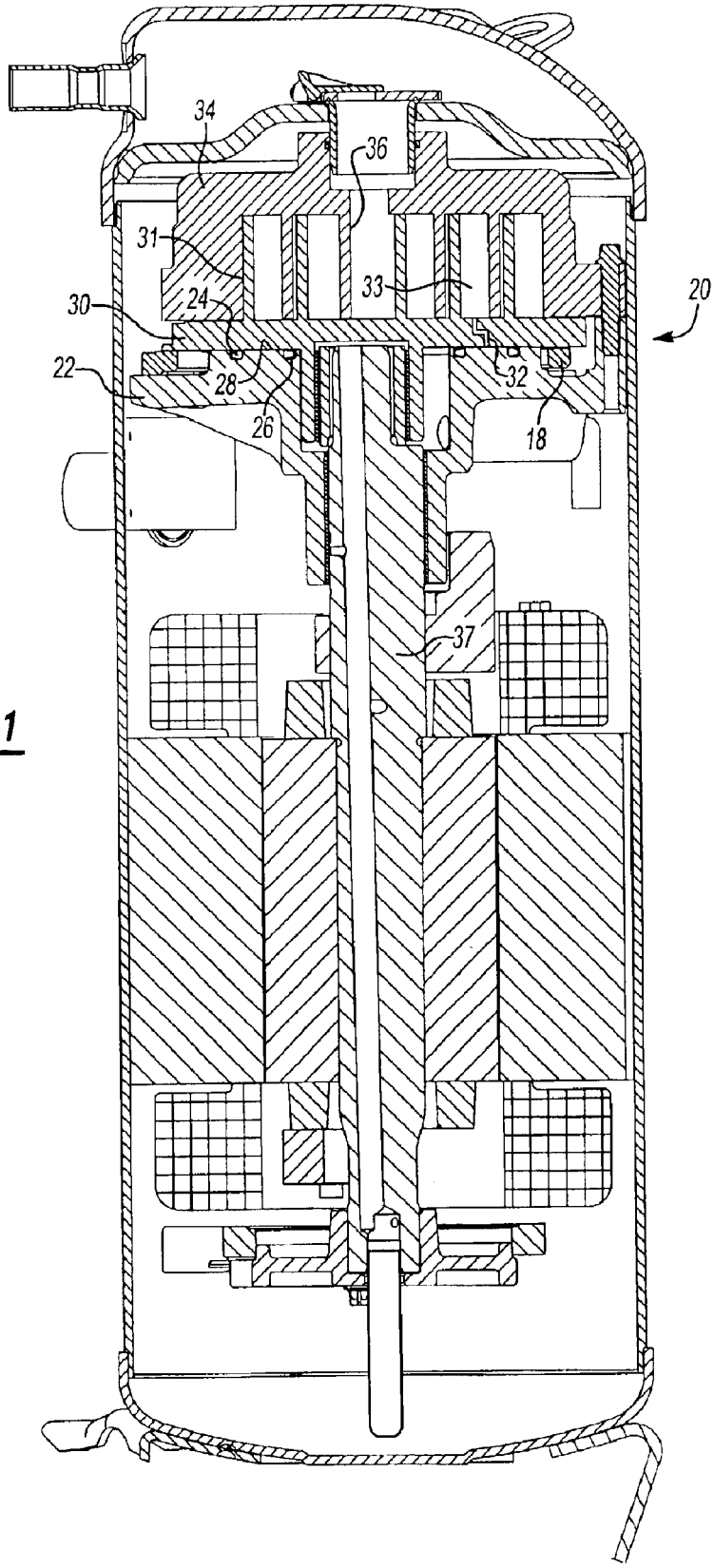
FIG. 1 is a cross-sectional view through a scroll compressor according to this invention.

A scroll compressor 20 is illustrated in FIG. 1. As known, a crankcase 22 supports an orbiting scroll 30. The crankcase 22 receives an outer seal 24 and an inner seal 26 which together define a back pressure chamber 28. A tap 32 extends between a compression chamber 33 and the back pressure chamber 28. The orbiting scroll 30 carries a wrap 31, which interfits with a non-orbiting scroll 34 having its wrap 36. The two wraps 31 and 36 interfit to define compression chambers such as chamber 33. The orbiting scroll 30 is driven to rotate by a shaft 37. The shaft could be said to define a center axis for the compressor 20.

In the prior art, the back pressure chamber 28 has historically been circular and centered on the center axis of the shaft 37. Again, in one patented prior compressor, the back pressure chamber was off-center. The present invention provides envelope improvements by allowing a smaller back pressure chamber, while still allowing for an orbit radius to accommodate the complete movement of the tap 32 being between the seals 24 and 26. As is known, an Oldham coupling 18 takes rotational movement of the shaft 37 and transmits orbital movement to the orbiting scroll 30.

Figure 2:
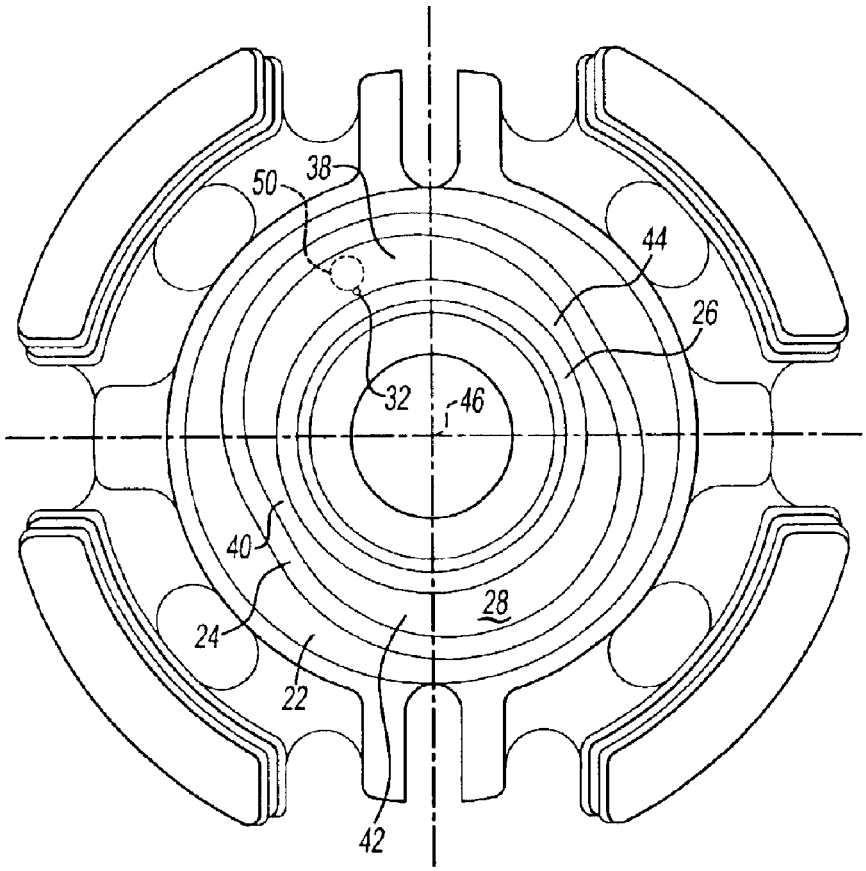
FIG. 2 is a top view of a crankcase embodying the present invention.

FIG. 2 shows a preferred shape for the seals 24 and 26. As shown, the inner seal 26 is circular while the outer seal 24 is generally oblong. Even so, both 26 and 24 are centered on a center axis 46. Since the two seals are concentric, the back pressure chamber 28 will also be concentric. In this way, there is no off-center force, which could raise performance issues. As can be seen, the back pressure chamber 28 includes larger portions 38 and 42, and smaller portions 40 and 44. The path of tap 32 through an orbit cycle is shown at 50. The portions are still all centered, and all forces should balance relative to the center axis 46. However, as can be seen, the overall size of the back pressure chamber 28 will be smaller than if the area 38 were a circular area. At the same time, by having the enlarged area 38, the orbit path 50 of the tap 32 is still accommodated between the seals 24 and 26.

While an oblong shape is shown, other shapes such as ovals, etc., which could still provide the basic shape could be utilized.

Now, a smaller back pressure chamber 28 can be designed to allow for smaller volume compression. Even so, the orbit path 50 of the tap 32 is still between the seals, and thus within the back pressure chamber.

While a preferred embodiment of this invention has been disclosed, a worker of ordinary skill in the art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from its base, said wraps of said first and second scroll members interfitting to define compression chambers;

a crankcase for supporting said second scroll member, and a drive shaft for driving said second scroll member to orbit relative to said first scroll member;

a back pressure chamber defined by a pair of seal surfaces and between a rear face of said base of said second scroll member and a forward face of said crankcase, said back pressure chamber being non-circular, and concentric about a center axis of said shaft.

2. A scroll compressor as recited in claim 1, wherein there are two separate seals defining said back pressure chamber.

3. A scroll compressor as recited in claim 1, wherein an inner seal is circular, and an outer seal is non-circular.

4. A scroll compressor as recited in claim 3, wherein said outer seal is generally oblong, but having a center axis concentric with the center axis of said inner seal.

5. A scroll compressor as recited in claim 1, wherein a tap extends through said second scroll member to communicate a compressed refrigerant to said back pressure chamber and said tap defining a path of travel during orbital movement of said second scroll member, with said path of travel being between said seal surfaces.

6. A scroll compressor as recited in claim 1, wherein said back pressure chamber being defined by seals in said crankcase sealing between a rear face of said base of said second scroll member and a forward face of said crankcase.

7. A scroll compressor an recited in claim 1, wherein said back pressure chamber non-circular configuration is defined in a plane extending perpendicular to a center axis of said drive shaft, and directly behind said rear face of said base of said second scroll member.

8. A scroll compressor comprising:

a first scroll member having a base and a generally spiral wrap extending from its base, said wraps of said first and second scroll members interfitting to define compression chambers;

a crankcase for supporting said second scroll member, and a driven shaft for driving said second scroll member to orbit relative to said first scroll member;

a back pressure chamber defined by a pair of seals in said crankcase and sealing between a rear face of said base of said second scroll member and a forward face of said crankcase, said back pressure chamber being non-circular, and concentric about a center axis of said shaft, a tap extending through said second scroll member to communicate a compressed refrigerant to said back pressure chamber, said tap defining a path of travel dining orbital movement of said second scroll member, said path of travel being between said sealed surfaces.

9. A scroll compressor as recited in claim 8, wherein there are two separate seals defining said back pressure chamber.

10. A scroll compressor as recited in claim 9, wherein an inner seal is circular, and an outer seal is non-circular.

11. A scroll compressor as recited in claim 10, wherein said outer seal is generally oblong, but having a center axis concentric with the center axis of said inner seal.

12. A scroll compressor as recited in claim 8, wherein said back pressure chamber non-circular configuration is defined in a plane extending perpendicular to a center axis of said drive shaft, and directly behind said rear face of said base of said second scroll member.

* * * * *

UNITED STATES PATENT AND TRADEMARK OFFICE

CERTIFICATE OF CORRECTION

PATENT NO. : 6,893,234 B2
DATED : May 17, 2005
INVENTOR(S) : Sun, Zili and Zamudio, Carlos It is certified that error appears in the above-identified patent and that said Letters Patent is hereby corrected as shown below:

Column 4,
Line 21, please replace "dining" with -- during --.

Signed and Sealed this

Sixteenth Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,893,234 B2
APPLICATION NO. : 10/345643
DATED : May 17, 2005
INVENTOR(S) : Zili Sun and Carlos Zamudio It is certified that error appears in the above-identified patent and that said Letters Patent is hereby corrected as shown below:

Column 4, Line 21
Please replace “dining” with --during--

Signed and Sealed this

First Day of January, 2008

JON W. DUDAS
*Director of the United States Patent and Trademark Office*